US012577721B2

(12) United States Patent
Yao et al.

(10) Patent No.: US 12,577,721 B2
(45) Date of Patent: Mar. 17, 2026

(54) AIR SUPPLY SYSTEM FOR WASHING APPARATUS, AND WASHING APPARATUS HAVING SAME

(71) Applicants: CHONGQING HAIER WASHING MACHINE CO., LTD., Chongqing (CN); Haier Smart Home Co., Ltd., Shandong (CN)

(72) Inventors: Dexiang Yao, Qingdao (CN); Risheng Su, Qingdao (CN); Xiangjiu Fang, Qingdao (CN); Yongshun Hou, Qingdao (CN)

(73) Assignees: CHONGQING HAIER WASHING MACHINE CO., LTD., Chongqing (CN); Haier Smart Home Co., Ltd., Qingdao (CN)

( * ) Notice: Subject to any disclaimer, the term of this patent is extended or adjusted under 35 U.S.C. 154(b) by 94 days.

(21) Appl. No.: 18/702,516

(22) PCT Filed: Oct. 10, 2022

(86) PCT No.: PCT/CN2022/124412
§ 371 (c)(1),
(2) Date: Apr. 18, 2024

(87) PCT Pub. No.: WO2023/066069
PCT Pub. Date: Apr. 27, 2023

(65) Prior Publication Data

US 2024/0410100 A1 Dec. 12, 2024

(30) Foreign Application Priority Data

Oct. 20, 2021 (CN) ..... 202111221589.4

(51) Int. Cl.
*D06F 37/26* (2006.01)
*D06F 25/00* (2006.01)
(Continued)

(52) U.S. Cl.
CPC ..... *D06F 37/267* (2013.01); *D06F 25/00* (2013.01); *D06F 35/00* (2013.01); *D06F 37/266* (2013.01); *D06F 39/00* (2013.01)

(58) Field of Classification Search
CPC ..... D06F 25/00; D06F 35/00; D06F 37/266; D06F 37/267; D06F 39/00
See application file for complete search history.

(56) References Cited

U.S. PATENT DOCUMENTS 4,112,590 A * 9/1978 Muller ..... D06F 58/24 34/77
6,434,857 B1 * 8/2002 Anderson ..... F26B 21/083 68/19
(Continued)

FOREIGN PATENT DOCUMENTS

CN 101158100 A 4/2008
CN 106521876 A 3/2017
(Continued)

OTHER PUBLICATIONS

International Search Report issued Jan. 3, 2023, in corresponding International Application No. PCT/CN2022/124412, 7 pages.

*Primary Examiner* — Joseph L. Perrin
(74) *Attorney, Agent, or Firm* — Maier & Maier, PLLC

(57) ABSTRACT

An air supply system for a washing apparatus, and a washing apparatus having same including: a fan; an air duct chamber, a first air passage duct and a second air passage duct, which are spaced apart from each other, are arranged in the air duct chamber; an air supply pipe, where the air supply pipe can be in communication with an exhaust port of the fan by the first air passage duct, and the air supply pipe is positioned so as to be able to supply air to a window pad of a washing apparatus by running the fan. With this system, residual water in the window pad can be effectively removed to prevent bacteria breeding and odor generation caused by
(Continued)

residual water; also, moist air can be discharged out of the washing apparatus in a timely manner to prevent the moist air from causing pipeline pollution and component erosion.

9 Claims, 4 Drawing Sheets

(51) Int. Cl.
*D06F 35/00* (2006.01)
*D06F 39/00* (2020.01)

(56) References Cited

U.S. PATENT DOCUMENTS 8,984,692 B2 * 3/2015 Balinski ..... D06F 33/43 8/149.1
11,085,137 B2 * 8/2021 Salvi ..... D06F 37/304
2006/0123854 A1 * 6/2006 Hong ..... D06F 58/22 68/24
2008/0078209 A1 * 4/2008 Kim ..... D06F 58/203 68/4
2008/0078210 A1 * 4/2008 Kim ..... D06F 35/00 68/4
2013/0104607 A1 * 5/2013 Broitzman ..... D06F 29/00 68/13 R
2014/0290313 A1 * 10/2014 Kulkarni ..... D06F 25/00 68/19.2

FOREIGN PATENT DOCUMENTS

CN 109306597 A 2/2019
CN 110552173 U 12/2019
CN 112301626 A 2/2021
CN 113215777 A 8/2021
CN 215887608 U 2/2022
CN 215887610 U 2/2022
CN 216129809 U 3/2022
CN 115125699 A 9/2022
JP 2010246700 A 11/2010
WO 2013066857 A1 5/2013

* cited by examiner

Partially enlarged view of portion A

AIR SUPPLY SYSTEM FOR WASHING APPARATUS, AND WASHING APPARATUS HAVING SAME

FIELD

The present disclosure relates to a washing apparatus, and specifically to an air supply system for a washing apparatus and a washing apparatus having the air supply system.

BACKGROUND

A washing apparatus is a cleaning appliance that typically uses a mechanical force generated by electrical energy to wash items to be washed such as clothing and bedding. The washing apparatus can clean the items to be washed conveniently, quickly and efficiently, thus freeing people from heavy housework. At present, there are various types of washing apparatuses, which mainly include drum washing apparatuses, pulsator washing apparatuses and paddle washing apparatuses, and which are used for washing items including but not limited to clothing, shoes, towels, carpets, or other washable items. The drum washing apparatuses (such as drum washing machines, drum dryers, drum type washing-drying integrated machines, etc.) have many advantages such as reliable quality, compact structure, and uniform washing, and therefore are favored by more and more users.

The drum washing apparatus usually includes components such as a shell, an outer cylinder fixed inside the shell, an inner cylinder rotatably fixed inside the outer cylinder, and an electric motor that can drive the inner cylinder to rotate. At the front of the shell, a door is also usually arranged, which forms a bolted connection with the shell so that the items to be washed can be placed into and taken out of the inner cylinder. In order to ensure good sealingness between the door and the outer cylinder, the drum washing apparatus in the prior art is generally provided with a window gasket with a wrinkle structure at an opening of the outer cylinder. During use of the drum washing apparatus, some washing water will inevitably remain on the window gasket, leading to growth of bacteria and generation of odors, which will greatly reduce the user experience.

In order to solve the above technical problem, extensive research and attempts have been made in the prior art. For example, Chinese patent application for invention CN109306597A discloses a drying method and structure for a clothing treatment device, and a clothing treatment device. At least one window gasket air duct pipeline is connected to a drying air duct of the clothing treatment device, and one end of the window gasket air duct pipeline extends into wrinkle grooves of the window gasket to dry the window gasket wrinkles. The clothing treatment device integrates an air supply system for drying the window gasket into a drying system to use hot air generated by the drying system to dry the window gasket. However, in order to improve a drying efficiency, the hot air generated by the drying system is usually controlled for recycled use, resulting in the inability to timely discharge humid air in the air supply system. Once the drying system stops working, the humid air may condense into liquid water again, thus contaminating pipelines and eroding components. Therefore, there is a possibility of improvement in the clothing treatment device.

Accordingly, there is a need for a new technical solution in the art to solve the above problem.

SUMMARY

In order to solve the above problem in the prior art, that is, to solve the technical problem that the air supply system of the washing apparatus in the prior art cannot timely discharge humid air, the present disclosure provides an air supply system for a washing apparatus. The air supply system includes: a fan; an air duct chamber, in which a first ventilation duct and a second ventilation duct spaced apart from each other are arranged; an air supply pipe, which can be communicated with an exhaust port of the fan through the first ventilation duct, and which is positioned to be capable of supplying air to a window gasket of the washing apparatus by operating the fan; an air return pipe and an exhaust pipe, in which the air return pipe can be communicated with the exhaust pipe through the second ventilation duct, and is positioned to be communicated with an interior of an outer cylinder of the washing apparatus, and the exhaust pipe is positioned to be communicated with an external environment, so as to force humid air inside the outer cylinder to be discharged into the external environment via the air return pipe and the exhaust pipe by operating the fan.

It can be understood by those skilled in the art that the air supply system for the washing apparatus of the present disclosure includes a fan, an air duct chamber, an air supply pipe, an air return pipe and an exhaust pipe. A first ventilation duct and a second ventilation duct spaced apart from each other are arranged on the air duct chamber. The air supply pipe is communicated with an exhaust port of the fan through the first ventilation duct, and is positioned to be capable of supplying air to a window gasket of the washing apparatus by operating the fan. Through the above arrangement, an airflow generated during the rotation of the fan can be directed to the window gasket through the first ventilation duct and the air supply pipe, thereby accelerating an evaporation rate of residual water on the window gasket for removal of the residual water. At the same time, the air return pipe is communicated with the exhaust pipe through the second ventilation duct, and is positioned to be communicated with the interior of the outer cylinder of the washing apparatus, and the exhaust pipe is positioned to be communicated with the external environment, so that evaporated humid air can be smoothly discharged to the external environment along the air return pipe, the second ventilation duct and the exhaust pipe in sequence under the action of the airflow caused by the rotation of the fan. Therefore, the air supply system for the washing apparatus of the present disclosure not only can accelerate the evaporation rate of residual water on the window gasket to effectively remove residual water and avoid growth of bacteria and generation of odors, but also can timely discharge the humid air out of the washing apparatus to prevent it from condensing into liquid water to contaminate pipelines and erode components.

In a preferred technical solution of the air supply system for the washing apparatus described above, the first ventilation duct and the second ventilation duct are arranged side by side. The side-by-side arrangement of the first ventilation duct and the second ventilation duct can make the structure of the air duct chamber simpler, more organized, and easy to machine.

In a preferred technical solution of the air supply system for the washing apparatus described above, the air supply system further includes an air valve structure arranged on the air duct chamber, and the air valve structure is configured to be capable of simultaneously controlling opening and closing of the first ventilation duct and the second ventilation duct. By arranging the air valve structure on the air duct chamber, it is possible to prevent washing water in the washing apparatus from flowing back into the first ventilation duct and the second ventilation duct to cause pollution to the ventilation ducts when the air supply system is idle.

In addition, the air valve structure is designed to be capable of simultaneously controlling the opening and closing of the first ventilation duct and the second ventilation duct, which can also simplify components, making the structure of the air supply system more compact.

In a preferred technical solution of the air supply system for the washing apparatus described above, the air valve structure includes: a first air valve plate arranged in the first ventilation duct; a second air valve plate arranged in the second ventilation duct; and a driving device, which is fixed on a sidewall of the air duct chamber and has a rotating shaft extending through the first ventilation duct and the second ventilation duct, in which the first air valve plate and the second air valve plate are fixed side by side on the rotating shaft, and the driving device is configured to be capable of driving the first air valve plate and the second air valve plate to rotate through the rotating shaft so as to open or close the first ventilation duct and the second ventilation duct. By controlling the driving device to drive the rotating shaft to rotate, the first air valve plate and the second air valve plate fixed on the rotating shaft are driven to rotate together, so as to simultaneously open or close the first ventilation duct and the second ventilation duct.

In a preferred technical solution of the air supply system for the washing apparatus described above, one end of the air supply pipe extends into the first ventilation duct and forms a fixed connection with a first connector having a first through hole, and a first closing protrusion capable of closing the first through hole is formed on the first air valve plate; one end of the air return pipe extends into the second ventilation duct and forms a fixed connection with a second connector having a second through hole, and a second closing protrusion capable of closing the second through hole is formed on the second air valve plate. By providing the first connector and the second connector, an assembly efficiency of the air supply pipe, the air return pipe and the air duct chamber can be improved. In addition, by providing the first closing protrusion that matches the first connector on the first air valve plate and providing the second closing protrusion that matches the second connector on the second air valve plate, the sealingness can also be improved.

In a preferred technical solution of the air supply system for the washing apparatus described above, the air supply pipe, the air return pipe and the exhaust pipe are hoses made of plastic materials. By configuring all of the air supply pipe, the air return pipe and the exhaust pipe into hoses made of plastic materials, not only the limited and irregular installation space inside the washing apparatus can be adapted to, but also the manufacturing cost can be reduced. In addition, the assembly, disassembly and replacement are also facilitated.

In order to solve the above problem in the prior art, that is, to solve the technical problem that the air supply system of the washing apparatus in the prior art cannot timely discharge humid air, the present disclosure also provides a washing apparatus. The washing apparatus includes: an outer cylinder, a window gasket being arranged at an opening of the outer cylinder and surrounding the opening; and the air supply system for a washing apparatus as described in any of the above items, the air supply system being arranged on the outer cylinder. By adopting the air supply system for the washing apparatus as described in any of the above items, the washing apparatus of the present disclosure not only can accelerate the evaporation rate of residual water on the window gasket to effectively remove residual water and avoid growth of bacteria and generation of odors, but also can timely discharge the humid air out of the washing apparatus to prevent it from condensing into liquid water to contaminate pipelines and erode components.

In a preferred technical solution of the washing apparatus described above, a connecting pipe that can receive the air supply pipe is arranged at an upper portion or a top portion of the window gasket, and the connecting pipe extends into the opening. Through the above arrangement, the airflow generated in the air supply system can be smoothly directed to the window gasket to blow-dry the residual water.

In a preferred technical solution of the washing apparatus described above, an air guide portion is formed at a distal end of the connecting pipe, and the air guide portion extends in a direction from a circumferential wall of the connecting pipe obliquely toward a centerline of the connecting pipe. By providing the air guide portion on the connecting pipe, a guiding effect can be further improved and the efficiency of the air supply system in blow-drying residual water can be increased.

In a preferred technical solution of the washing apparatus described above, a ventilation hole communicated with the interior of the outer cylinder is arranged at an upper portion or a top portion of the outer cylinder so that air communication is formed between the air return pipe and the interior of the outer cylinder. By arranging the ventilation hole communicated with the interior of the outer cylinder at the top portion of the outer cylinder, air communication is formed between the air return pipe and the interior of the outer cylinder, so that the humid air inside the outer cylinder can be conveniently discharged.

BRIEF DESCRIPTION OF DRAWINGS

Preferred embodiments of the present disclosure will be described below in connection with the accompanying drawings, in which.

DETAILED DESCRIPTION

Figure 1:
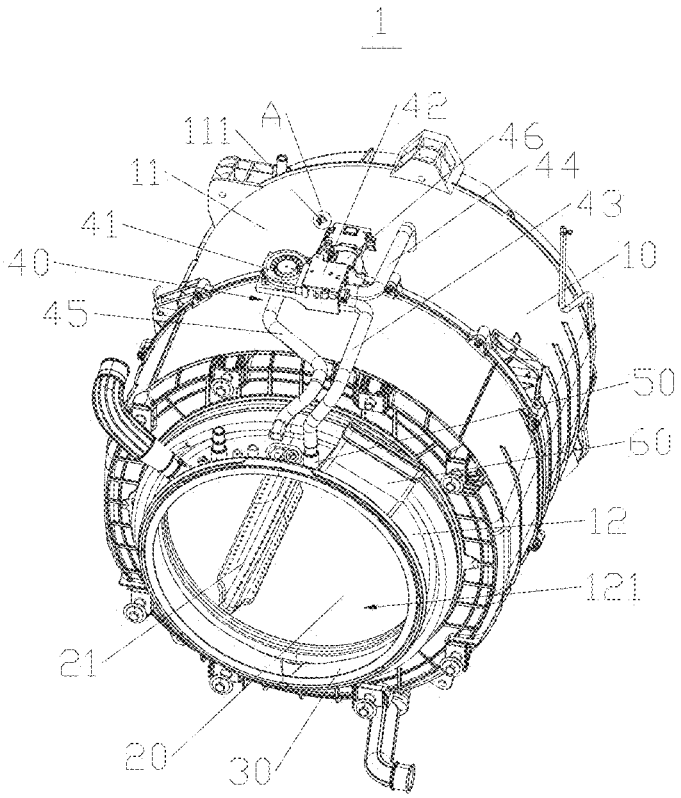
FIG. 1 is a schematic structural view of an embodiment of the washing apparatus of the present disclosure.

Preferred embodiments of the present disclosure will be described below in connection with the accompanying drawings. It should be understood by those skilled in the art that these embodiments are only used to explain the technical principle of the present disclosure, and are not intended to limit the scope of protection of the present disclosure.

It should be noted that in the description of the present disclosure, terms indicating directional or positional relationships, such as "upper", "lower", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure. In addition, terms "first" and "second" are only used for descriptive purpose, and should not be understood as indicating or implying relative importance.

In addition, it should also be noted that in the description of the present disclosure, unless otherwise clearly specified and defined, terms "install", "arrange" and "connect" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

In order to solve the technical problem that the air supply system of the washing apparatus in the prior art cannot timely discharge humid air, the present disclosure provides an air supply system 40 for a washing apparatus. The air supply system 40 includes: a fan 41; an air duct chamber 42, on which a first ventilation duct 421 and a second ventilation duct 422 spaced apart from each other are arranged; an air supply pipe 43, which can be communicated with an exhaust port 414 of the fan 41 through the first ventilation duct 421, and which is positioned to be capable of supplying air to a window gasket 30 of the washing apparatus 1 by operating the fan 41; an air return pipe 44 and an exhaust pipe 45, in which the air return pipe 44 can be communicated with the exhaust pipe 45 through the second ventilation duct 422, and is positioned to be communicated with an interior of an outer cylinder 10 of the washing apparatus 1, and the exhaust pipe 45 is positioned to be communicated with an external environment, so as to force humid air inside the outer cylinder 10 to be discharged into the external environment via the air return pipe 44 and the exhaust pipe 45 by operating the fan 41.

FIG. 1 is a schematic structural view of an embodiment of the washing apparatus of the present disclosure. As shown in FIG. 1, in one or more embodiments, the washing apparatus 1 of the present disclosure is a drum type washing-drying integrated machine. Alternatively, the washing apparatus 1 can also be a drum washing machine, a drum dryer, or another suitable washing apparatus. The washing apparatus 1 includes a shell (not shown in the figure), an outer cylinder 10 fixed inside the shell, an inner cylinder 20 rotatably fixed inside the outer cylinder 10, a window gasket 30, an air supply system 40, a drying system (not shown in the figure), and other components. The shell is made of ABS, aluminum alloy or other suitable materials, and encloses a space that can accommodate other components. At the front of the shell, a door (not shown in the figure) is also arranged, so that the items to be washed can be placed into and taken out of the inner cylinder 20.

As shown in FIG. 1, in one or more embodiments, the outer cylinder 10 is made of suitable resin materials such as ABS and PP to reduce the weight and lower the cost. Alternatively, the outer cylinder 10 can also be made of suitable metal materials such as galvanized steel to enhance its strength and prolong its service life. In one or more embodiments, the outer cylinder 10 is fixed inside the shell through components such as a counterweight spring and a vibration damper (not shown in the figure) to reduce the vibration generated during the rotation of the inner cylinder 20. As shown in FIG. 1, the outer cylinder 10 has an approximately cylindrical circumferential wall 11 to define an accommodation space that can accommodate the inner cylinder 20. Based on the orientation shown in FIG. 1, an annular wall 12 is formed at the front of the circumferential wall 11, and the annular wall 12 extends in a direction toward the front (i.e., away from the plane of paper) to enclose an approximately circular opening 121. A window gasket 30 surrounding the opening 121 is arranged on the annular wall 12 to improve the sealingness between the door and the outer cylinder 10. The window gasket 30 can be made of suitable materials such as rubber through injection molding process to simplify the manufacturing process and reduce the manufacturing cost.

Figure 2:
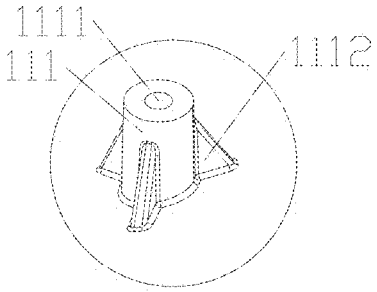
FIG. 2 is a partially enlarged view of a portion A of the embodiment of the washing apparatus of the present disclosure as shown in FIG. 1.

With continued reference to FIG. 1, in one or more embodiments, a ventilation pipe 111 is arranged at a top portion of the circumferential wall 11 of the outer cylinder 10. Alternatively, the ventilation pipe 111 can also be arranged on other suitable parts of the outer cylinder 10, such as on an upper portion of the outer cylinder 10. The ventilation pipe 111 can be integrally formed with the outer cylinder 10 through injection molding process to simplify the manufacturing process. Alternatively, the ventilation pipe 111 can also be separately machined and then fixed to the circumferential wall 11 of the outer cylinder 10. The fixing means includes but is not limited to threaded connection, snap-fit connection, etc. FIG. 2 is a partially enlarged view of a portion A of the embodiment of the washing apparatus of the present disclosure as shown in FIG. 1. As shown in FIG. 2, the ventilation pipe 111 is a hollow tubular structure of an approximately cylindrical shape, so that air communication can be formed between the interior of the outer cylinder 10 and the outside thereof through a ventilation hole 1111 inside the ventilation pipe 111. In one or more embodiments, three reinforcing ribs 1112 spaced apart from each other are also formed on a circumferential sidewall of the ventilation pipe 111 to enhance the strength of the ventilation pipe 111. Alternatively, the number of the reinforcing ribs 1112 can be set to be larger or smaller than three, or another suitable number. Alternatively, the shape of the ventilation pipe 111 can also be configured into square, ellipse, or another suitable shape. Alternatively, the ventilation hole 1111 inside the ventilation pipe 111 can also be configured into square, ellipse, or another suitable shape. Further, the number of the ventilation pipe 111 can also be set to be more than one, such as two, three, etc.

As shown in FIG. 1, in one or more embodiments, the inner cylinder 20 is made of stainless steel to enhance its strength and prolong its service life. The inner cylinder 20 has an approximately cylindrical shape to enclose a washing chamber in which the items to be washed can be placed. A plurality of spin-drying holes spaced apart from each other are formed on a circumferential sidewall of the inner cylinder 20, so that when the inner cylinder 20 rotates along its own rotation axis under the drive of a motor (not shown in the figure), the moisture in the items to be washed can be thrown out under the centrifugal force. A plurality of lifting ribs 21 spaced apart from each other are also arranged on the circumferential sidewall of the inner cylinder 20, so that when the items to be washed roll inside the inner cylinder 20, they can be driven by the lifting ribs 21 to turn over up and down, thereby improving the action of mechanical force and enhancing the washing and drying effects.

In one or more embodiments, the drying system of the washing apparatus 1 is arranged at the top portion of the circumferential wall 11 of the outer cylinder 10. The drying system includes but is not limited to including components such as a drying fan, a heating component, and a drying air duct 60. As shown in FIG. 1, one end of the drying air duct 60 is arranged at the upper portion of the annular wall 12 of the outer cylinder 10. When the drying system is working, the drying fan rotates to generate an airflow, which is heated to become hot air after passing through the heating component. The hot air is conveyed into the inner cylinder 20 under the guidance of the drying air duct 60 and exchanges heat with the items to be washed inside the inner cylinder 20, thereby taking away the moisture in the items to be washed and achieving the purpose of drying.

As shown in FIG. 1, in one or more embodiments, the air supply system 40 is arranged at the top portion of the circumferential wall 11 of the outer cylinder 10. Alternatively, the air supply system 40 can also be arranged in another suitable space between the outer cylinder 10 and the shell, such as at the position of the upper portion of the outer cylinder 10. The air supply system 40 can start working after the drying system stops working or when needed.

Figure 3:
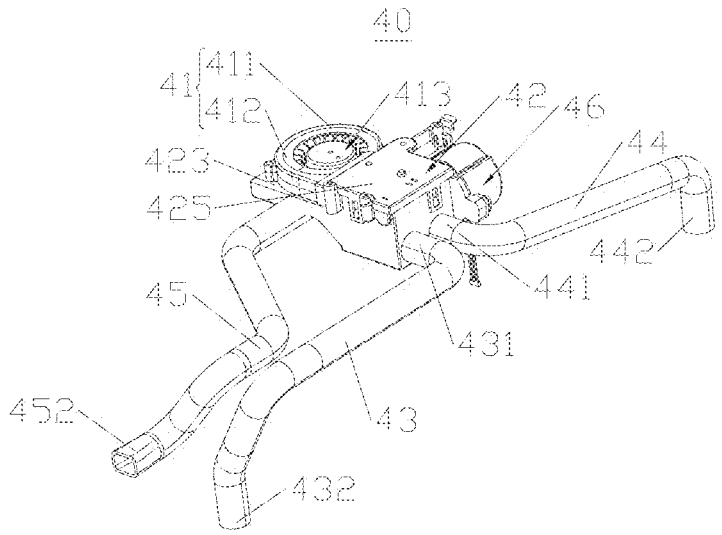
FIG. 3 is a schematic structural view of an embodiment of the air supply system for a washing apparatus of the present disclosure.

FIG. 3 is a schematic structural view of an embodiment of the air supply system for a washing apparatus of the present disclosure. As shown in FIG. 3, in one or more embodiments, the air supply system 40 includes components such as a fan 41, an air duct chamber 42, an air supply pipe 43, an air return pipe 44, and an exhaust pipe 45. By providing the air supply system 40, not only the residual water on the window gasket 30 in the washing apparatus 1 can be effectively removed, preventing the growth of bacteria and the generation of odors, but also the airflow generated by the air supply system 40 can be used to timely discharge the humid air out of the washing apparatus 1, preventing the humid air from staying in the washing apparatus 1 to contaminate and erode pipelines and components.

Figure 4:
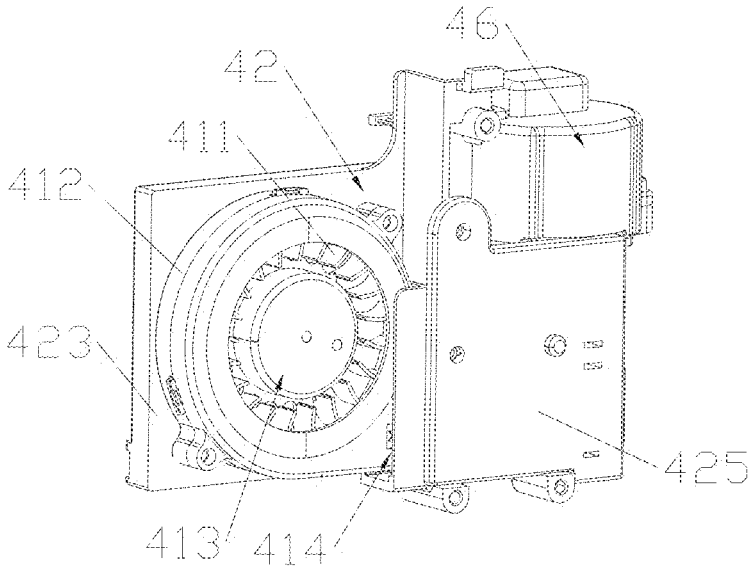
FIG. 4 is a schematic structural view of an embodiment of the air supply system for a washing apparatus of the present disclosure in which an air supply pipe, an air return pipe and an exhaust pipe are removed.

FIG. 4 is a schematic structural view of an embodiment of the air supply system for a washing apparatus of the present disclosure in which the air supply pipe, the air return pipe and the exhaust pipe are removed. As shown in FIG. 4, in one or more embodiments, the fan 41 is fixed on a fan fixing bracket 423 of the air duct chamber 42, making the structure of the air supply system 40 more compact. Alternatively, the fan 41 can also be fixed in another suitable space between the outer cylinder 10 and the shell, as long as it can effectively convey airflow to the air supply pipe 43. In one or more embodiments, the fan 41 includes components such as an impeller 411, a volute 412, and a motor (not shown in the figure) that can drive the impeller 411 to rotate. The impeller 411 can be made of suitable resin materials such as ABS and PC to reduce the weight of the impeller 411 and lower the manufacturing cost. Alternatively, the impeller 411 can also be made of suitable metal materials such as aluminum and stainless steel to enhance its strength and prolong its service life. The impeller 411 can also be a forward skewed impeller, a radial impeller, or a backward skewed impeller. It can be understood that the shape and number of blades of the impeller 411 can be adjusted as actually required. With continued reference to FIG. 4, the volute 412 covers the impeller 411 and defines a suction port 413 and an exhaust port 414 of the fan 41. Based on the orientation shown in FIG. 4, the suction port 413 is located on a side of the impeller 411 that is away from the plane of paper. When the impeller 411 rotates under the drive of the motor, the air in the space between the outer cylinder 10 and the shell will be sucked into the volute 412 under the action of negative pressure, forming an air flow. The motor includes but is not limited to a stepping motor, a servo motor, etc. Alternatively, the suction port 413 can also be configured to be communicated with the external environment through a pipeline, so as to draw air (i.e., "fresh air") from the external environment into the volute 412. The exhaust port 414 is configured to be communicated with the first ventilation duct 421 in the air duct chamber 42, so as to convey air flow into the first ventilation duct 421.

Figure 5:
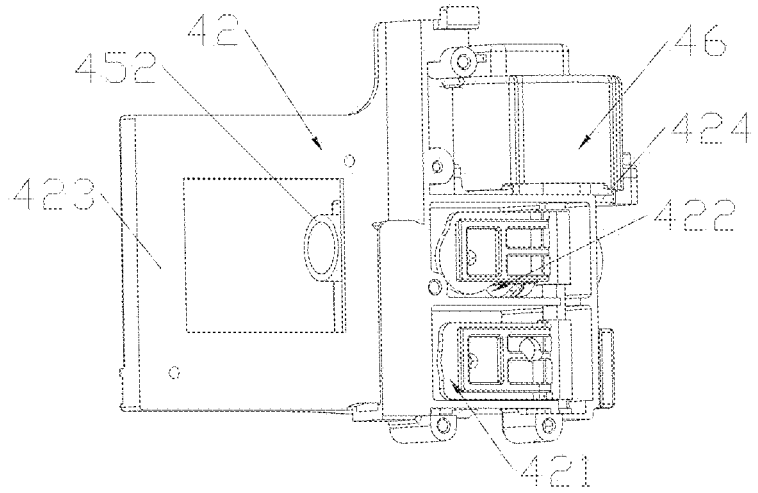
FIG. 5 is a schematic structural view of an embodiment of the air supply system for a washing apparatus of the present disclosure in which the air supply pipe, the air return pipe, the exhaust pipe, a fan and a cover are removed.

FIG. 5 is a schematic structural view of an embodiment of the air supply system for a washing apparatus of the present disclosure in which the air supply pipe, the air return pipe, the exhaust pipe, the fan and a cover are removed. In one or more embodiments, the air duct chamber 42 includes components such as the first ventilation duct 421, the second ventilation duct 422, the fan fixing bracket 423, and a cover plate 425 (see FIG. 4). Alternatively, when the air supply system 40 further includes an air valve structure 46, a fixing bracket 424 for air valve motor is also provided on the air duct chamber 42. Based on the orientation shown in FIG. 5, the fan fixing bracket 423 is located on the left side of the air duct chamber 42. The fixing bracket 424 for air valve motor can be located on the upper side of the second ventilation duct 422, or can be located on the lower side of the first ventilation duct 421. The first ventilation duct 421, the second ventilation duct 422, the fan fixing bracket 423, and the fixing bracket 424 for air valve motor can be integrally formed through injection molding process using suitable resin materials such as ABS and PP to simplify the manufacturing process and lower the manufacturing cost. The cover plate 425 is an approximately rectangular plate-like structure, which is fixed and covered on the first ventilation duct 421 and the second ventilation duct 422 to enclose an air duct. The cover plate 425 can also be integrally formed through injection molding process using suitable resin materials such as ABS and PP. The ways of fixing the cover plate 425 to the first ventilation duct 421 and the second ventilation duct 422 include but are not limited to threaded connection, snap-fit connection, etc.

Figure 6:
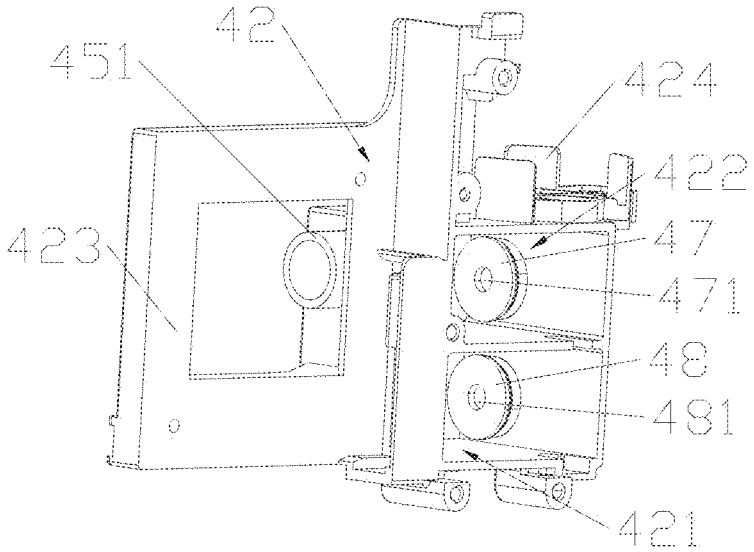
FIG. 6 is a first schematic structural view of an embodiment of the air supply system for a washing apparatus of the present disclosure in which the air supply pipe, the air return pipe, the exhaust pipe, the fan, the cover and an air valve structure are removed.
Figure 7:
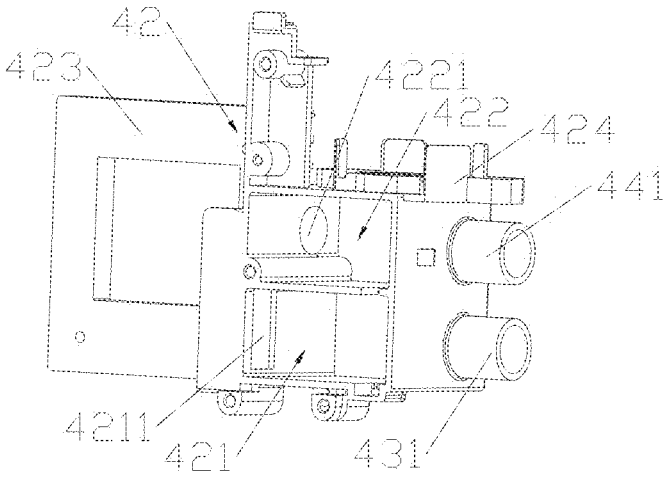
FIG. 7 is a second schematic structural view of an embodiment of the air supply system for a washing apparatus of the present disclosure in which the air supply pipe, the air return pipe, the exhaust pipe, the fan, the cover and the air valve structure are removed.

FIG. 6 is a first schematic structural view of an embodiment of the air supply system for a washing apparatus of the present disclosure in which the air supply pipe, the air return pipe, the exhaust pipe, the fan, the cover and the air valve structure are removed; and FIG. 7 is a second schematic structural view of an embodiment of the air supply system for a washing apparatus of the present disclosure in which the air supply pipe, the air return pipe, the exhaust pipe, the fan, the cover and the air valve structure are removed. As shown in FIGS. 6 and 7, in one or more embodiments, the first ventilation duct 421 and the second ventilation duct 422 are spaced apart from each other and arranged side by side, making the structure of the air duct chamber 42 more organized, simpler, and easy to machine. As shown in FIG. 7 and based on the orientation shown in FIG. 7, the first ventilation duct 421 has a first ventilation port 4211 located on the left side to match the exhaust port 414 of the volute 412. Referring to FIGS. 6 and 7, in one or more embodiments, a first connector 47 is also arranged on the right side of the first ventilation duct 421 for matching a first end 431 of the air supply pipe 43. In one or more embodiments, the first connector 47 is made of rubber to have a predetermined elasticity, so that the first connector 47 can be conveniently sleeved on the first end 431 of the air supply pipe 43. Alternatively, the first connector 47 can also be made of other suitable resin materials such as ABS, PP, etc., and a fixed connection can be formed between the first connector 47 and the first end 431 of the air supply pipe 43 through threaded connection, snap-fit connection and other suitable connection means. An approximately circular first through hole 471 is arranged on the first connector 47 so that air communication is formed between the first ventilation duct 421 and the air supply pipe 43. By providing the first connector 47, the assembly efficiency of the air supply pipe 43 can be improved, and a good sealing effect can also be achieved.

With continued reference to FIG. 7 and based on the orientation shown in FIG. 7, a second ventilation port 4221 located on the left side is formed on the second ventilation duct 422 to match a fifth end 451 of the exhaust pipe 45 (see FIG. 6). Referring to FIGS. 6 and 7, in one or more embodiments, a second connector 48 is also arranged on the right side of the second ventilation duct 422 for matching a third end 441 of the air return pipe 44. In one or more embodiments, the second connector 48 is made of rubber to have a predetermined elasticity, so that the second connector 48 can be conveniently sleeved on the third end 441 of the air return pipe 44. Alternatively, the second connector 48 can also be made of other suitable resin materials such as ABS, PP, etc., and a fixed connection can be formed between the second connector 48 and the third end 441 of the air return pipe 44 through threaded connection, snap-fit connection and other suitable connection means. An approximately circular second through hole 481 is arranged on the second connector 48 so that air communication is formed between the second ventilation duct 422 and the air return pipe 44. By providing the second connector 48, the assembly efficiency of the air return pipe 44 can be improved, and a good sealing effect can also be achieved.

As shown in FIG. 3, in one or more embodiments, the air supply pipe 43 is a plastic hose made of EPDM (i.e., a ternary copolymer of ethylene, propylene and non-conjugated diolefin), which gives the air supply pipe 43 a bendable characteristic for facilitating assembly in the limited space of the washing apparatus 1. Alternatively, the air supply pipe 43 can also be made of PVC, PE, or other suitable materials. The air supply pipe 43 has a first end 431 and a second end 432 that are opposite to each other. The first end 431 is configured to be communicated with the first ventilation duct 421 (see FIGS. 6 and 7). The second end 432 is configured to be communicated with a connecting pipe 50 arranged at the top portion of the annular wall 12 (see FIG. 1).

Figure 9:
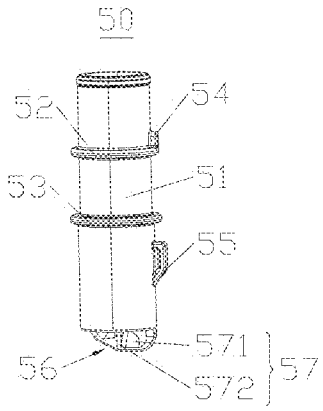
FIG. 9 is a schematic structural view of an embodiment of a connecting pipe in the washing apparatus of the present disclosure.

FIG. 9 is a schematic structural view of an embodiment of the connecting pipe in the washing apparatus of the present disclosure. As shown in FIG. 9, in one or more embodiments, the connecting pipe 50 has a hollow connecting pipe body 51 of an approximately cylindrical shape. A first limiting protrusion 52 and a second limiting protrusion 53 spaced apart from each other are formed on a circumferential sidewall of the connecting pipe body 51. The first limiting protrusion 52 can define the position where the air supply pipe 43 is inserted into the connecting pipe 50, and the second limiting protrusion 53 can define the position where the connecting pipe body 51 is inserted into the annular wall 12. In one or more embodiments, a first fastening protrusion 54 and a second fastening protrusion 55 are also formed on the circumferential sidewall of the connecting pipe body 51. The first fastening protrusion 54 is located at a position close to the first limiting protrusion 52, so that a firm fixed connection can be formed between the air supply pipe 43 and the connecting pipe body 51. The second fastening protrusion 55 is located at a position close to the second limiting protrusion 53, so that a firm fixed connection can be formed between the connecting pipe body 51 and the annular wall 12. In one or more embodiments, an air guide portion 57 is also arranged at a distal end 56 of the connecting pipe body 51. Based on the orientation shown in FIG. 9, the air guide portion 57 is an arc-shaped wall 571 that extends in a direction from the circumferential sidewall of the connecting pipe body 51 obliquely toward a centerline of the connecting pipe body 51. The arrangement of the arc-shaped wall 571 can change the direction of airflow, so that the air flow conveyed in a vertical direction is guided to blow toward the window gasket 30 substantially in a horizontal direction, so as to increase a contact area between the air flow and the window gasket 30 and enhance the air supply effect. In one or more embodiments, the air guide portion 57 further includes a separation rib 572 extending vertically outward from the arc-shaped wall 571. The separation rib 572 can increase an air supply range of the air flow and further enhance the air supply effect.

With continued reference to FIG. 3, in one or more embodiments, the air return pipe 44 is a plastic hose made of EPDM, which gives the air return pipe 44 a bendable characteristic for facilitating assembly in the limited space of the washing apparatus 1. Alternatively, the air return pipe 44 can also be made of PVC, PE, or other suitable materials. The air return pipe 44 has a third end 441 and a fourth end 442 that are opposite to each other. The third end 441 is configured to be communicated with the second ventilation duct 422 (see FIGS. 6 and 7). The fourth end 442 is configured to face the circumferential wall 11 of the outer cylinder 10 and is spaced from the circumferential wall 11 by a predetermined distance (see FIG. 1).

With continued reference to FIG. 3, in one or more embodiments, the exhaust pipe 45 is a plastic hose made of EPDM, which gives the exhaust pipe 45 a bendable characteristic for facilitating assembly in the limited space of the washing apparatus 1. Alternatively, the exhaust pipe 45 can also be made of PVC, PE, or other suitable materials. The exhaust pipe 45 has a fifth end 451 and a sixth end 452 that are opposite to each other. The fifth end 451 is configured to be communicated with the second ventilation duct 422 (see FIGS. 6 and 7), so that the exhaust pipe 45 is communicated with the air return pipe 44 through the second ventilation duct 422. The sixth end 452 is configured to be communicated with the external environment so that the humid air can be timely discharged. In one or more embodiments, a ventilation hole (not shown in the figure) is arranged at the front of the shell of the washing apparatus 1, and the ventilation hole is matched with the sixth end 452 of the exhaust pipe 45. Alternatively, the position of the ventilation hole can also be set at other suitable positions on the shell. In addition, when the air supply system 40 is working, users can perceive the working condition of the air supply system 40 through the ventilation hole to improve the user experience.

As shown in FIG. 5, in one or more embodiments, the air supply system 40 further includes an air valve structure 46. The air valve structure 46 is configured to be capable of simultaneously controlling opening and closing of the first ventilation duct 421 and the second ventilation duct 422. The arrangement of the air valve structure 46 can prevent the washing water in the washing apparatus 1 from flowing back into the first ventilation duct 421 and the second ventilation duct 422 to contaminate the ventilation ducts when the air supply system 40 is idle. In addition, the air valve structure 46 is designed to be capable of simultaneously controlling the opening and closing of the first ventilation duct 421 and the second ventilation duct 422, which can also simplify components, making the structure of the air supply system 40 more compact.

Figure 8:
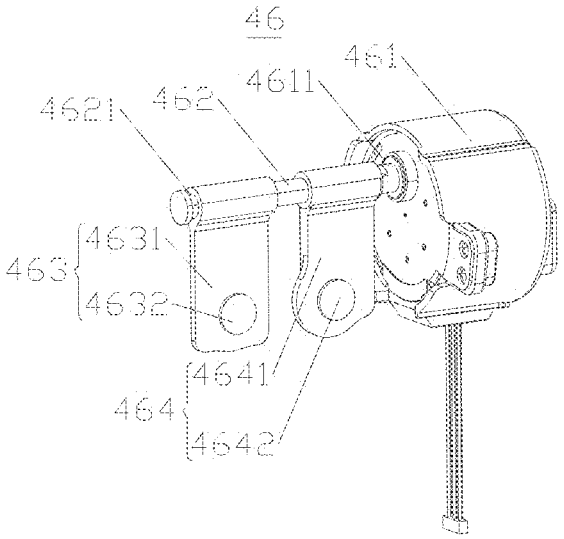
FIG. 8 is a schematic structural view of an embodiment of the air valve structure in the air supply system for a washing apparatus of the present disclosure.

FIG. 8 is a schematic structural view of an embodiment of the air valve structure in the air supply system for a washing apparatus of the present disclosure. As shown in FIG. 8, in one or more embodiments, the air valve structure 46 includes components such as a driving device, a rotating shaft 462, a first air valve plate 463, and a second air valve plate 464. In one or more embodiments, the driving device is an air valve motor 461. Alternatively, the driving device can be another suitable device that can achieve the rotation. The air valve motor 461 is fixed on the fixing bracket 424 for air valve motor in the air duct chamber 42. The fixing means includes but is not limited to threaded connection, snap-fit connection, etc. The air valve motor 461 can be a stepping motor, a servo motor, or another suitable motor. The air valve motor 461 has an air valve motor shaft 4611. The air valve motor shaft 4611 is configured to form a fixed connection with the rotating shaft 462. The rotating shaft 462 extends into the first ventilation duct 421 and the second ventilation duct 422. In one or more embodiments, the rotating shaft 462 has a fixed end 4621 away from the motor shaft 4611, and the fixed end 4621 is configured to be rotatably fixed on the sidewall of the first ventilation duct 421 that is away from the second ventilation duct 422, so that the rotating shaft 462 can be fixed on the air duct chamber 42 more firmly. A first air valve plate 463 and a second air valve plate 464 that are side by side and spaced apart from each other are formed on the rotating shaft 462, so that the first air valve plate 463 and the second air valve plate 464 are driven to rotate together with the rotating shaft 462 under the drive of the air valve motor 461, thereby simultaneously controlling the opening and closing of the first ventilation duct 421 and the second ventilation duct 422. The first air valve plate 463, the second air valve plate 464 and the rotating shaft 462 can be integrally formed through injection molding process using suitable resin materials such as ABS and PP, so as to simplify the manufacturing process and lower the manufacturing cost. Alternatively, the first air valve plate 463 and the second air valve plate 464 can also be separately machined and then fixed on the rotating shaft 462. The fixing means includes but is not limited to threaded connection, snap-fit connection, etc. The first air valve plate 463 has an approximately rectangular first air valve plate body 4631. Based on the orientation shown in FIG. 8, a first closing protrusion 4632 is formed on the first air valve plate body 4631, and the first closing protrusion 4632 extends vertically outward from the first air valve plate body 4631. The first closing protrusion 4632 has an approximately circular shape to match the first through hole 471 on the first connector 47. Alternatively, the first closing protrusion 4632 can also be configured into other suitable shapes other than circle, such as square, ellipse, etc., as long as it can match the first through hole 471 to close the first through hole 471. Correspondingly, the second air valve plate 464 has an approximately rectangular second air valve plate body 4641. Based on the orientation shown in FIG. 8, a second closing protrusion 4642 is formed on the second air valve plate body 4641, and the second closing protrusion 4642 extends vertically outward from the second air valve plate body 4641. The second closing protrusion 4642 has an approximately circular shape to match the second through hole 481 on the second connector 48. Alternatively, the second closing protrusion 4642 can also be configured into other suitable shapes other than circle, such as square, ellipse, etc., as long as it can match the second through hole 481 to close the second through hole 481.

After the air supply system 40 for the washing apparatus 1 of the present disclosure receives an opening signal, for example, after the spinning program of the washing apparatus 1 is completed, the fan 41 in the air supply system 40 is controlled to start running. The impeller 411 rotates under the drive of the motor, generating an airflow. The airflow enters the first ventilation duct 421 in the air duct chamber 42 from the exhaust port 414 of the volute 412. Then, the airflow passes through the air supply pipe 43 and the connecting pipe 50 in sequence, and under the guidance of the air guide portion 57 at the distal end 56 of the connecting pipe 50, blows toward the window gasket 30. The action of airflow accelerates the evaporation rate of residual water on the window gasket 30, converting it into gaseous water. Then, under the drive of the airflow, the gaseous water is discharged out of the inner cylinder 20 from the spin-drying holes on the circumferential sidewall of the inner cylinder 20, and is discharged out of the outer cylinder 10 from the ventilation hole 1111 arranged on the circumferential wall 11 of the outer cylinder 10. Then, the airflow with gaseous water (i.e., humid air) enters the air return pipe 44 from the fourth end 442 of the air return pipe 44, passes through the air return pipe 44, the second ventilation duct 422 and the exhaust pipe 45 in sequence, and finally is discharged out of the washing apparatus 1 from the sixth end of the exhaust pipe 45. Therefore, by adopting the air supply system 40 for the washing apparatus 1 of the present disclosure, the residual water on the window gasket 30 can be effectively removed; at the same time, the humid air after evaporation of the residual water can be timely discharged from the washing apparatus 1, thereby improving the dehumidification effect.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. An air supply system for a washing apparatus, the air supply system comprising:

a fan;

an air duct chamber, in which a first ventilation duct and a second ventilation duct spaced apart from each other are arranged;

an air supply pipe, which is configured to be communicated with an exhaust port of the fan through the first ventilation duct, and which is positioned to supply air to a window gasket of the washing apparatus by operating the fan;

an air return pipe and an exhaust pipe, wherein the air return pipe is communicated with the exhaust pipe through the second ventilation duct, and is positioned to be communicated with an interior of an outer cylinder of the washing apparatus, and the exhaust pipe is positioned to be communicated with an external environment, so as to force humid air inside the outer cylinder to be discharged into the external environment via the air return pipe and the exhaust pipe by operating the fan; and an air valve structure arranged on the air duct chamber, and the air valve structure is configured to be capable of simultaneously controlling opening and closing of the first ventilation duct and the second ventilation duct.

2. The air supply system according to claim 1, wherein the first ventilation duct and the second ventilation duct are arranged side by side.

3. The air supply system according to claim 1, wherein the air valve structure comprises:

a first air valve plate arranged in the first ventilation duct;

a second air valve plate arranged in the second ventilation duct; and a driving device, which is fixed on a sidewall of the air duct chamber and has a rotating shaft extending through the first ventilation duct and the second ventilation duct, wherein the first air valve plate and the second air valve plate are fixed side by side on the rotating shaft, and the driving device is configured to be capable of driving the first air valve plate and the second air valve plate to rotate through the rotating shaft so as to open or close the first ventilation duct and the second ventilation duct.

4. The air supply system according to claim 3, wherein one end of the air supply pipe extends into the first ventilation duct and forms a fixed connection with a first connector having a first through hole, and a first closing protrusion capable of closing the first through hole is formed on the first air valve plate; and one end of the air return pipe extends into the second ventilation duct and forms a fixed connection with a second connector having a second through hole, and a second closing protrusion capable of closing the second through hole is formed on the second air valve plate.

5. The air supply system according to claim 1, wherein the air supply pipe, the air return pipe and the exhaust pipe are hoses made of plastic materials.

6. A washing apparatus, comprising:

an outer cylinder and a window gasket arranged at an opening of the outer cylinder and surrounding the opening; and the air supply system according to claim 1, wherein the air supply system being arranged on the outer cylinder.

7. The washing apparatus according to claim 6, wherein a connecting pipe that can receive the air supply pipe is arranged at an upper portion or a top portion of the window gasket, and the connecting pipe extends into the opening.

8. The washing apparatus according to claim 7, wherein an air guide portion is formed at a distal end of the connecting pipe, and the air guide portion extends in a direction from a circumferential wall of the connecting pipe obliquely toward a centerline of the connecting pipe.

9. The washing apparatus according to claim 6, wherein a ventilation hole communicated with the interior of the outer cylinder is arranged at an upper portion or a top portion of the outer cylinder so that air communication is formed between the air return pipe and the interior of the outer cylinder.

* * * * *